US005267552A

United States Patent [19]

Squires et al.

[11] Patent Number: 5,267,552

[45] Date of Patent: Dec. 7, 1993

[54] DIRECT VENT GAS FIREPLACE

[75] Inventors: David G. Squires, Minesing; Andrew C. G. Wilkes; James E. Kovacs, both of Barrie, all of Canada

[73] Assignee: Hunter Enterprises (Orillia) Limited, Orillia, Canada

[21] Appl. No.: 890,143

[22] Filed: May 29, 1992

[51] Int. Cl.[5] ..... F24C 3/00

[52] U.S. Cl. ..... 126/512; 126/515; 126/500; 126/522; 737/55

[58] Field of Search ..... 126/512, 500, 515, 523, 126/529, 522; 237/50, 52, 53, 55

[56] References Cited

U.S. PATENT DOCUMENTS

| | | | |
|---|---|---|---|
| 3,056,397 | 10/1962 | Little . | |
| 3,981,292 | 9/1976 | Lilly et al. | 126/522 |
| 4,026,263 | 5/1977 | Boyd | 126/522 X |
| 4,076,010 | 2/1978 | Andrews | 126/500 |
| 4,141,336 | 2/1979 | Fitch . | |
| 4,519,376 | 5/1985 | Schoeff et al. . | |
| 4,553,528 | 11/1985 | Wells . | |
| 4,793,322 | 12/1988 | Shimek et al. . | |
| 4,898,154 | 2/1990 | Richison | 126/500 |
| 4,909,227 | 3/1990 | Rieger . | |

OTHER PUBLICATIONS

Product brochure for the Majestic G42HV, undated.

*Primary Examiner*—Larry Jones

*Attorney, Agent, or Firm*—Robert H. Wilkes

[57] ABSTRACT

A direct vent gas fireplace has a firebox surrounded by an enclosure. The enclosure has an inclined surface between the top, rear and sides. The surface is inclined at approximately 45 degrees and has an exhaust opening. The firebox has an inclined surface parallel to the inclined panel and has an aperture in each side of the firebox. A duct connects each of the apertures to the exhaust opening. A heat exchanger lies between the inclined surfaces in line with the duct. The surface has a gap in it which connects through an air combustion conduit to the bottom of the firebox. The conduit may be pre-formed. An angle adaptor has an inner cap over the exhaust opening and an outer cap over the inner cap and the gap. The adaptor may be mounted vertically or horizontally. Alternatively, an inclined plate may be placed over the inclined surface with a hole concentric with the opening and of greater area. A first wall of a double walled vent duct may enclose the opening, while the second wall encloses the hole.

25 Claims, 10 Drawing Sheets

DIRECT VENT GAS FIREPLACE

FIELD OF THE INVENTION

The invention relates to improvements in direct vent gas fireplaces.

BACKGROUND OF THE INVENTION

Vented fireplaces come in three vent types: conventional, power and direct.

Conventional vents are those seen everyday, where exhaust is vented through a chimney using convection.

Power vents exhaust flue products using a power driven blower. They are particularly useful on horizontal or off-vertical runs where it is necessary to supplement the natural bouyancy of the flue products. The decrease in lift from the exhaust on a horizontal run can make it difficult to vent products of combustion.

A direct vent fireplace uses a two duct system. Combustion air is drawn from the outside of a dwelling through one duct, while the exhaust gases are vented through the other duct. This overcomes much of the problem of drawing air for combustion from within the house and allows for vertical and horizontal runs within limits specific to the fireplace specifications without the use of a fan.

In most direct vent units available today, the ducts come in the form of a single double-walled co-axial duct. The exhaust flows through the inner duct and the combustion air in the outer. The exhaust heats the combustion air increasing the efficiency of the unit and the combustion air cools the exhaust air before it is released outside, allowing the vent to be placed nearer to objects which could be affected by heat.

Co-axial direct vent units come in one of two forms, top and rear vent. Rear vent units vent exhaust from an opening in the rear of a firebox through a concentric opening at the rear of the unit, while top vent units vent from an opening on the top of the firebox through a concentric opening on the top of the unit.

In order to have the duct of a rear vent unit exit a building at a point other than directly behind the opening at the rear of the unit, the unit must be placed away from the wall and the duct must have a bend or elbow in it. Unless the desired exit is in direct line with the bent duct, this must be followed by a further bend. This results in a unit which is further away from the wall than may be desired and a duct which takes some effort to install.

The opening in a top vented unit is over the firebox and, as a result, is only a short distance from the front of the unit. Usually this distance is insufficient for a mantlepiece, unless the duct is bent towards the rear of the unit. Even so, the mantlepiece must be placed at a height above the forward portion of the duct. This can detract from the appearance of the finished fireplace. Also, even if the fireplace can be vented to the rear at the height of the fireplace, a full elbow is required to direct the duct.

Most modern gas fireplaces are pre-fabricated units. The basic types are zero clearance, insert, free-standing and wallmount. A zero clearance fireplace, as its name suggests, can be placed against combustible materials. An insert is a unit made to fit within an existing solid fuel burning fireplace, and may use the existing chimney. A free-standing unit may be placed on the floor in a room without support from the wall and may be spaced a distance from the wall. A wall mount is placed on and supported by a wall in the room.

Air flows by convection or with the use of a fan, through a passage between the bottom of the firebox and the bottom of the unit, around the rear and sides of the firebox, and out across the top of the firebox directing heat into the room. In order to increase the efficiency of the unit, some manufacturers place a heat exchanger for top vented units in-line with the exhaust outlet over the top of the firebox in the circulating air passage. The heat exchanger impedes the flow of the exhaust gases and provides additional heat transfer surface area which allows for additional heating of the room air.

In many jurisdictions, the firebox must contain relief doors to relieve pressure which may be created from a gas explosion. An explosion can occur when an explosive mixture of gas and air accumulates within the firebox and is ignited. The maximum pressure under these conditions must be kept below the pressure that would break the viewing window or otherwise damage the fireplace. The preferred position for relief doors is at the top of the firebox. This allows for gravity closure of the relief door, simplifying the design.

As space is limited in direct vent gas fireplaces some manufacturers have decreased the size of the relief door on top vented units and added a relief door at the rear of the firebox.

Typically, in direct vented units the combustion air is brought down the rear of the unit and enters the rear of the firebox through a pair of tunnels. In order to prevent the combustion air from unnaturally impinging on the flame, canopies are placed over the tunnel entrances to the firebox in an effort to force the air to come from below the burner. To improve on this, manufacturers have used a false bottom over the canopies which better directs the air flow to the burners. Neither of these solutions are optimal.

SUMMARY OF THE INVENTION

In a first aspect the invention provides a direct vent gas fireplace having a firebox with top, rear, bottom and two side panels, and a front viewing window. An enclosure is spaced away from the firebox and has top, rear, bottom and two side surfaces. A passage for room air is located between the enclosure and the firebox. An exhaust opening is in an inclined surface of the enclosure located between the top, rear, and side surfaces and inclined to the top and rear surfaces. A duct connects the opening to at least one exhaust aperture in the firebox. A combustion air conduit exits into the firebox and commences at a gap in the inclined surface.

In this aspect an aperture may be in one of the side panels of the firebox. There may be two apertures, one in each side panel, with the duct connecting the opening to each of the apertures. Also, a heat exchanger may be placed in line with the duct in the passage.

The firebox may have an inclined panel between the top, rear and side panels parallel to the inclined surface. The inclined surface may fall within a range of from 30 to 60 degrees from vertical. Alternatively, it may be at either 30, 45, or 60 degrees from vertical.

The heat exchanger may rest substantially between the inclined surface and the inclined panel, within the passage. The aperture may be in one of the side panels of the firebox with a portion of the duct connecting the aperture to an underside of the heat exchanger extending beyond the side panel in which the aperture is located.

Alternatively, there may be two apertures, one in each side panel, with two portions of the duct connecting the apertures to the underside of the heat exchanger beyond either side panel.

The conduit may be formed from a sheet spaced away from the rear surface toward the passage so that the gap is between the sheet and the rear surface. At least one tunnel would extend from the space between the rear surface and the sheet toward a tray beneath the bottom of the firebox. The space would be enclosed to the rear surface from the sheet. The combustion air flows through the gap past the sheet, through the tunnel, over the tray and into the firebox through the bottom panel. The conduit may be formed from a pre-fabricated combustion air conduit unit. The bottom panel can be sloped upwardly from the front to the rear, with a fan resting in the passage to the rear and bottom of the fireplace, and the tunnel passing above the fan into the tray.

In a second aspect the invention provides an angle adaptor for use in association with a fireplace comprising an exhaust opening and a gap in a surface inclined between the top and rear surfaces of the fireplace enclosure. The angle adaptor has an inner cap for mounting to the enclosure over the opening, the inner cap having an exhaust outlet.

The angle adaptor also has an outer cap for mounting to the enclosure over the inner cap and the gap. The outer cap has an air inlet about the exhaust outlet. The inner and outer caps define a combustion air channel from the inlet to the gap and the caps are able to be mounted in at least a substantially horizontal and a substantially vertical position, in the horizontal position the axis of the exhaust outlet is substantially horizontal and in the vertical position the axis of the exhaust outlet is substantially vertical.

In a third aspect the invention provides a combination of the first two aspects.

In a fourth aspect the invention provides a kit containing a fireplace and adaptor according to the first two aspects.

In a fifth aspect the invention provides a direct vent gas fireplace according to the first aspect wherein the opening is partially offset from the firebox.

In a sixth aspect the invention provides a direct vented gas fireplace having a firebox with top, rear, bottom and two side panels, and a front viewing window. An enclosure is spaced away from the firebox and has top, rear, bottom and two side surfaces. A passage for room air is located between the enclosure and the firebox. An exhaust opening is in an inclined surface of the enclosure between the top, rear, and side surfaces and inclined to the top and rear surfaces. A duct connects the opening to at least one exhaust aperture in the firebox. A combustion air conduit exits into the firebox and commences at a gap in the inclined surface. An inclined plate is substantially parallel to the inclined surface over the gap and the outlet. The plate has a hole substantially concentric with the outlet and of greater area.

In this aspect the fireplace may be in combined with a double walled vent duct, a first wall of which encloses the outlet and a second wall encloses the hole. The duct is connected to a vent cap in a source of combustion air and exhaust release.

BRIEF DESCRIPTION OF THE DRAWINGS

For a better understanding of the present invention and to show more clearly how it may be carried into effect, reference will now be made, by way of example, to the accompanying drawings which show preferred embodiments of the present invention and in which.

DETAILED DESCRIPTION OF THE PREFERRED EMBODIMENTS

Figure 1:
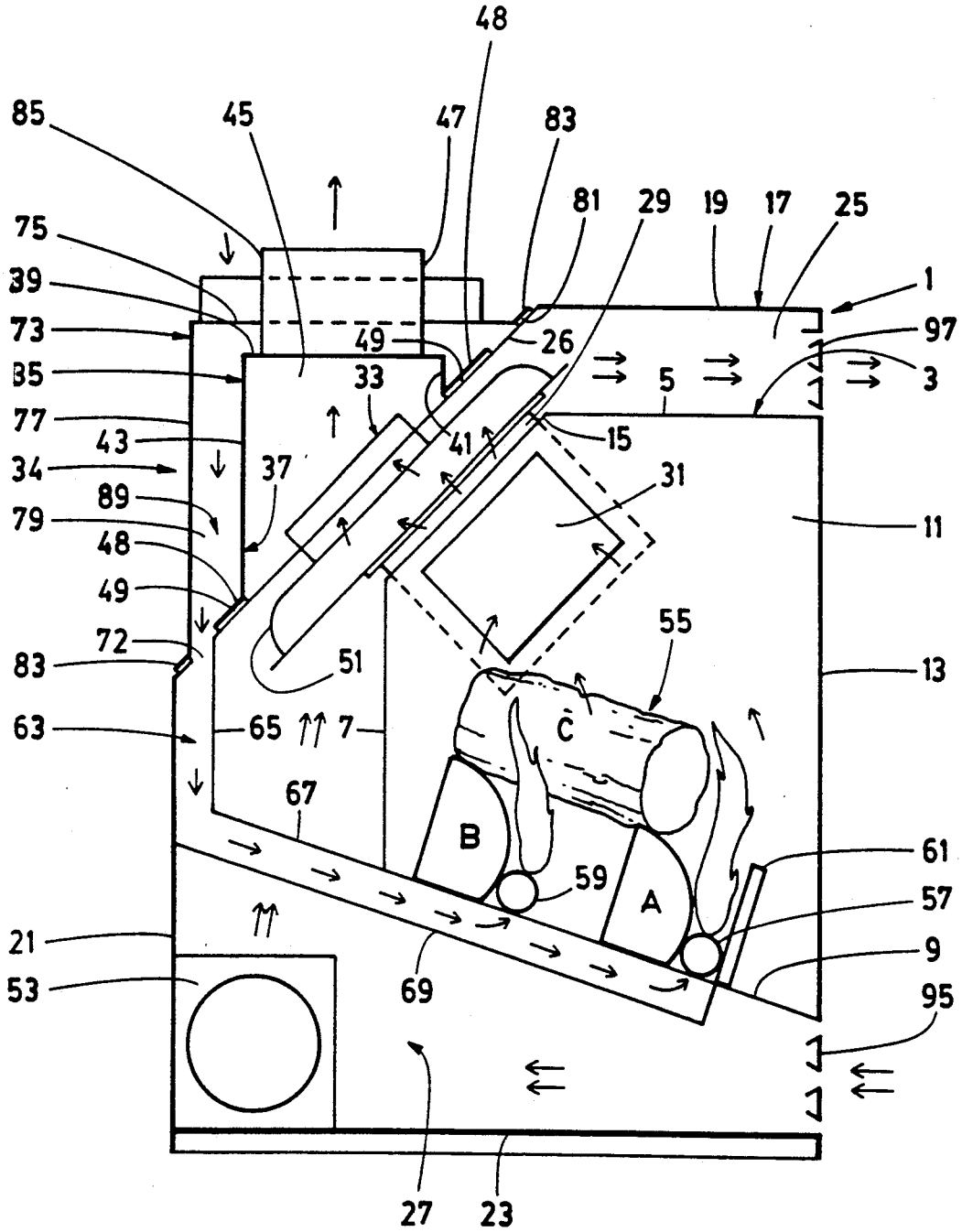
FIG. 1 is a cross-sectional side view through the lines A—A of FIG. 2 of embodiments of a fireplace and an angle adaptor assembled in a vertical position.
Figure 2:
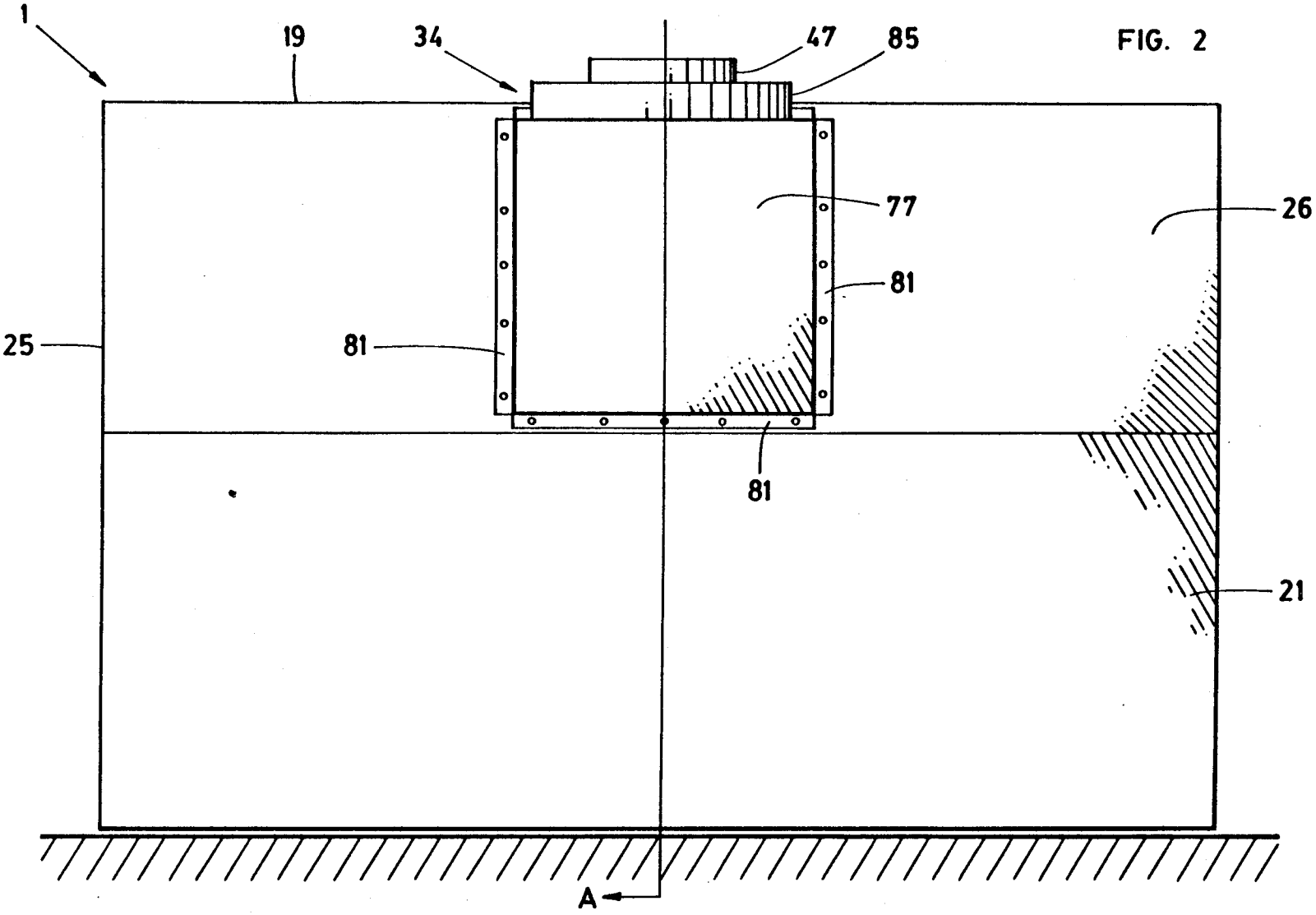
FIG. 2 is a rear elevation view of the assembly of FIG. 1.

Referring to the drawings, a gas fireplace 1 has a firebox 3 with top, rear, bottom and side panels 5, 7, 9, 11 and viewing window 13. Between the top, rear and side panels, 5, 7, 11 is an inclined panel 15.

The firebox 3 sits within an enclosure 17 having top, rear, bottom and side surfaces 19, 21, 23, 25. Between the top, rear and side surfaces 19, 21, 25 of the enclosure 17 is an inclined surface 26. The enclosure 17 is spaced away from the firebox 3 and defines a passage 27.

A duct 29 connects apertures 31 side panels 11 to an exhaust opening 33 in the inclined surface 26. For the purposes of this discussion of the embodiment, the fireplace 1 is symmetrical and although only one aperture 31 is shown in the Figures, there is one in each side panel 11.

Figure 7:
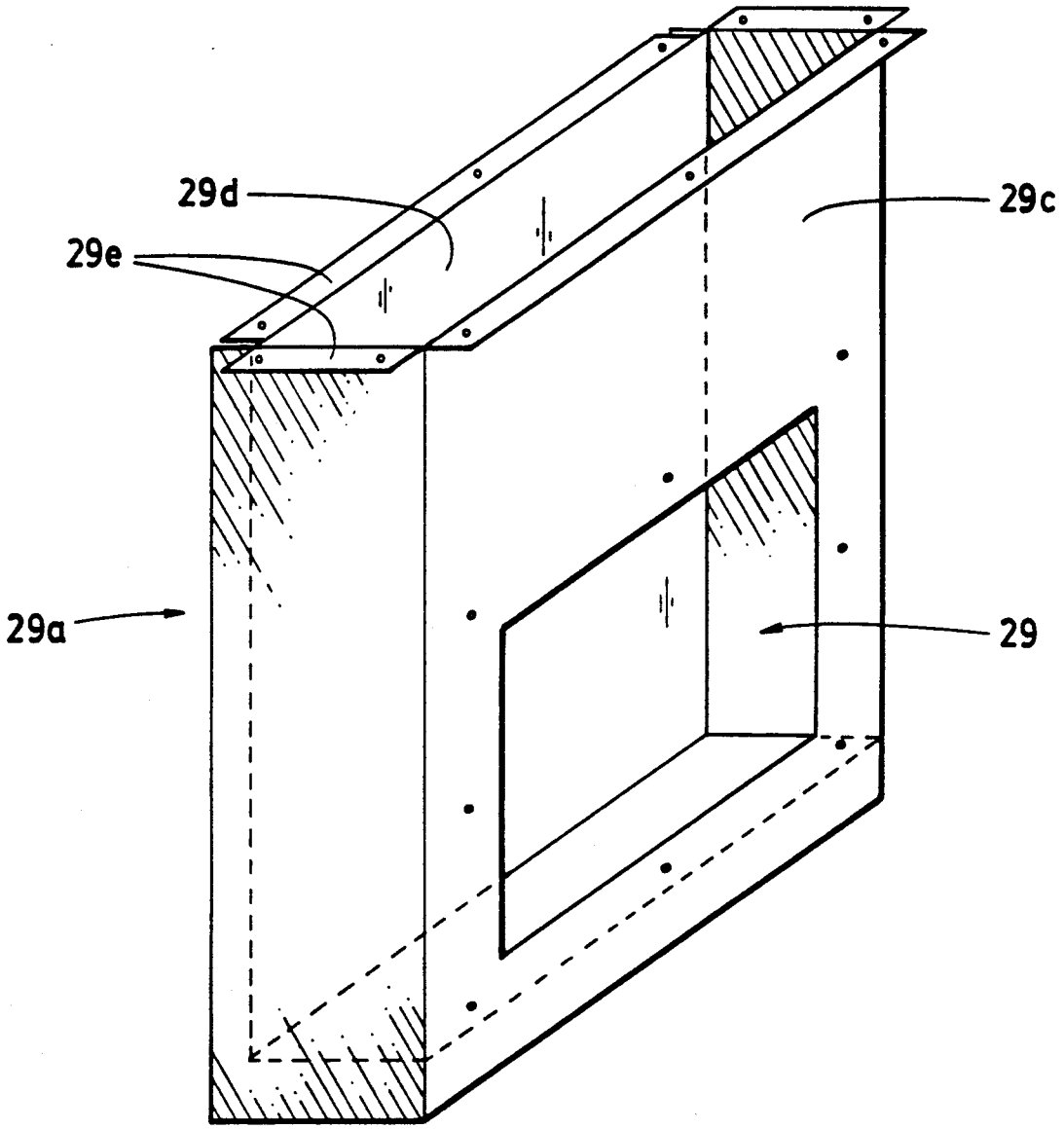
FIG. 7 is a perspective view of a duct used in the fireplace of FIG. 1.

FIG. 7 illustrates a portion 29*a* of the duct 29 which is simply a rectangular box having a cut-out 29*b* in one wall 29*c*. One portion 29*a* is used on each side of the firebox 3 and the cut-outs 29*b* are placed over each aperture 31. The wall 29*c* is fastened to the side panel 11 using sheet metal screws, not shown, or the like. The duct 29 is also open at one end 29*d* which has flanges 29*e* for fastening to other components which will be discussed below.

As shown in FIGS. 1–2 and 4–6, mounted on the outside of the inclined surface 26 over the opening 33 is an angle adaptor 34 having an inner cap 35. The angle adaptor does not form part of the fireplace 1, but is mounted to it. The inner cap 35 has a lower portion 37 having a rectangular top 39, front 41, rear 43, and sides 45. The front 41 is substantially shorter than the rear 43 and the sides 45 are angled to allow the lower portion 37 to mount on the inclined surface 26 with the top 39 lying substantially horizontal. Extending substantially vertical from the top 39 is an inner collar 47 which opens into the lower portion 37. Flanges 48 extend from the front 41, rear 43 and sides 45 over an inner gasket 49 and may be mounted using sheet metal screws, not shown, or the like.

Figure 3:
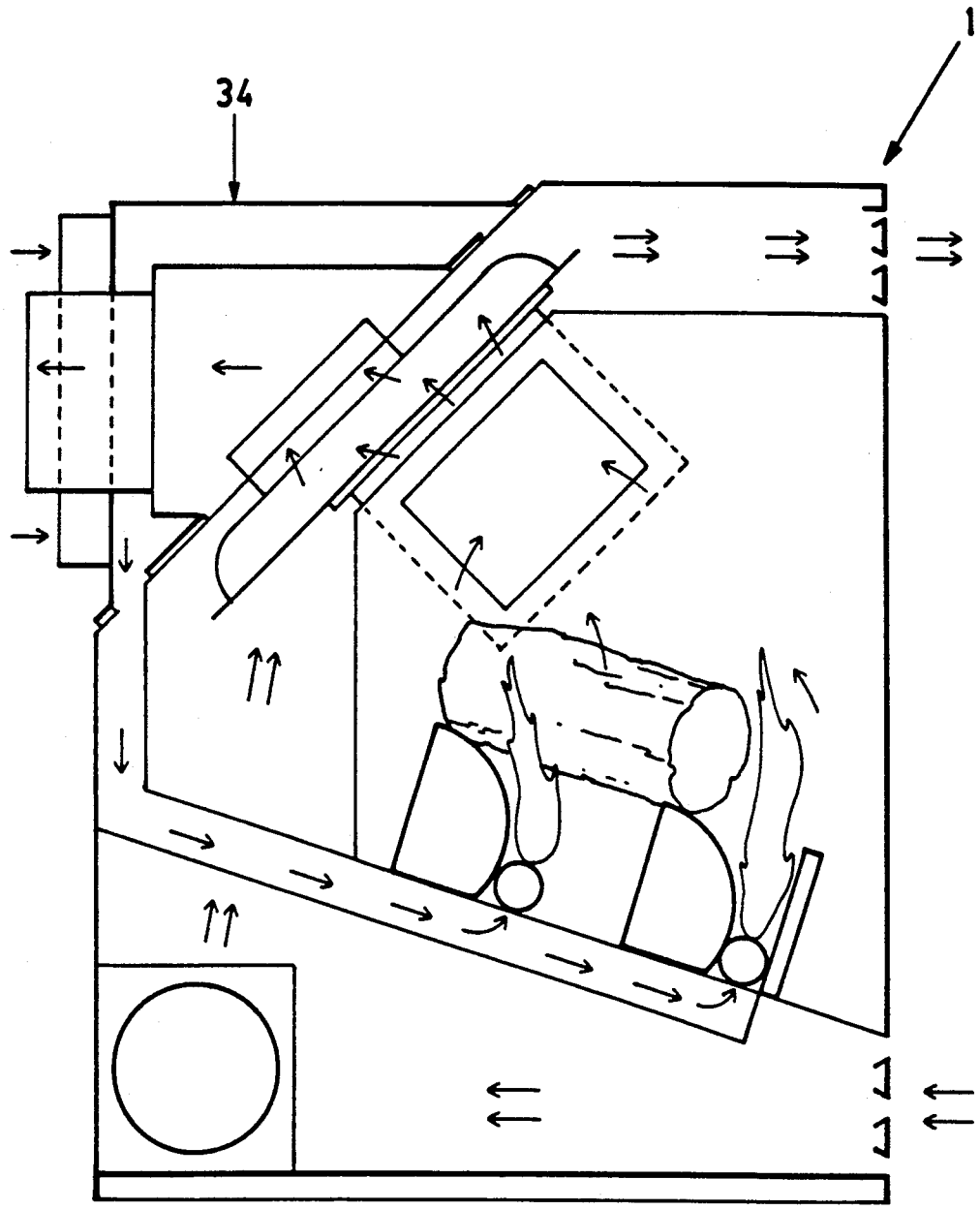
FIG. 3 is a cross-sectional view of the fireplace and angle adaptor of FIG. 1 assembled in a horizontal position.
Figure 4:
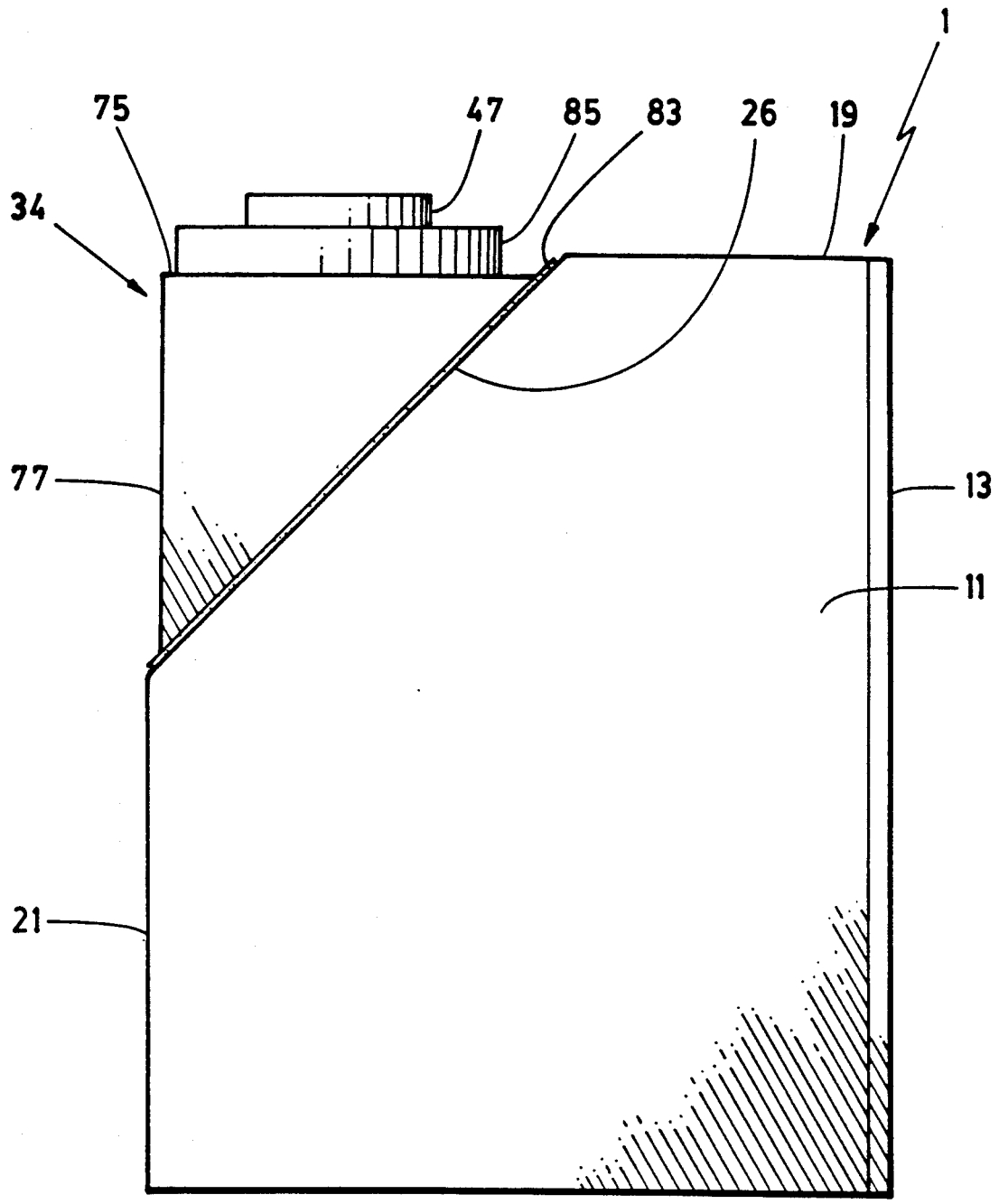
FIG. 4 is a side elevation of the assembly of FIG. 1.
Figure 5:
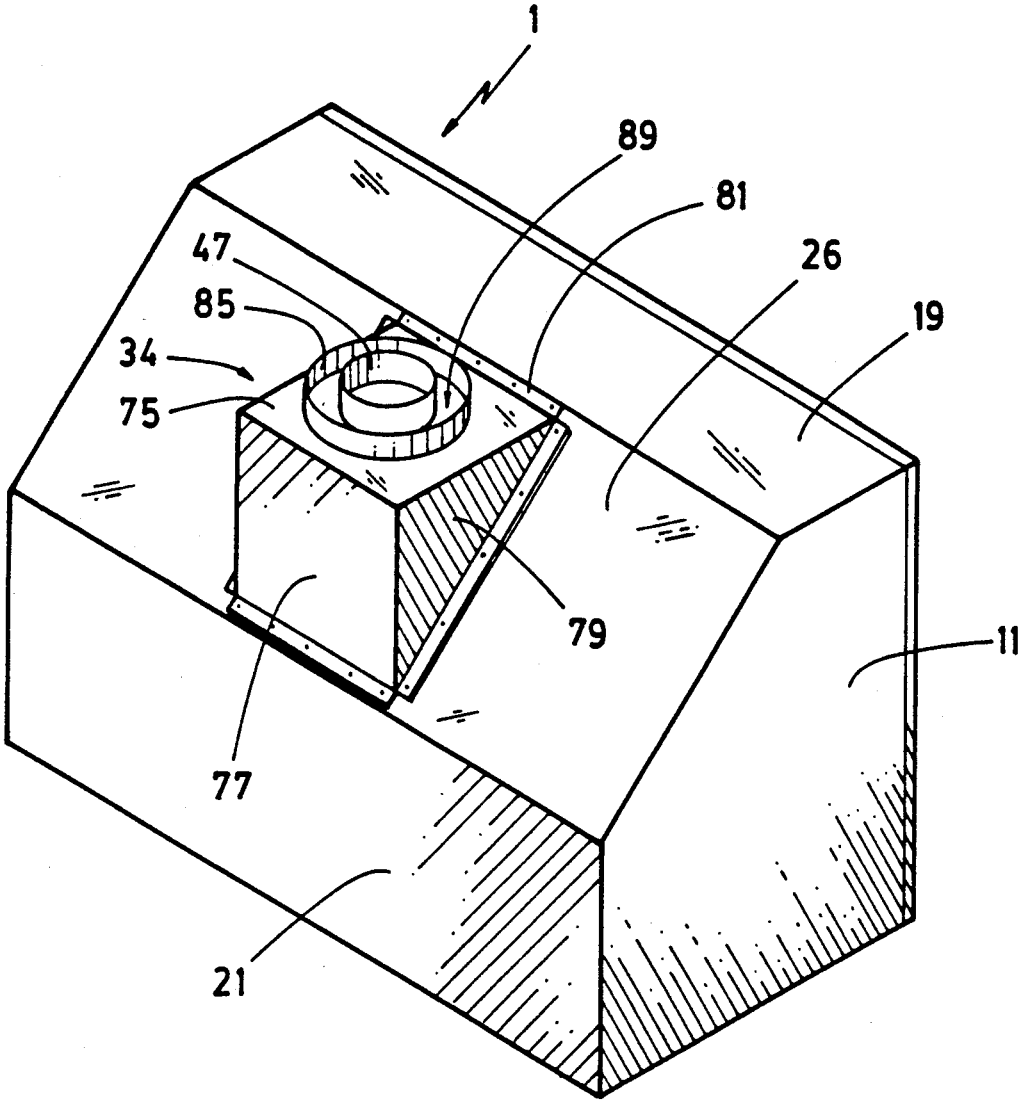
FIG. 5 is a perspective view from above, to the rear and the side of the assembly of FIG. 1.

As shown in FIG. 3, the adaptor 34 may also be mounted with the inner collar 47 extending substantially horizontally.

This allows the fireplace 1 to be installed in applications which were previously specific to top vent fireplaces, not shown, or to rear vent fireplaces, not shown. As is evident, it is preferable for the inclined surface to rest at substantially 45 degrees in order to be mounted in either the vertical or horizontal positions. However, other combinations of adaptor and fireplaces are possible which produce a similar effect.

One of the advantages to the vertical position over traditional top vented fireplaces, not shown, can be to have the means for conducting the flue products at the height of the top 19, in this case where the inner collar 47 is substantially vertical, offset to the rear from the firebox 1. This can allow additional depth for a mantlepiece to be placed closer to the top 19. By offset, it is meant that a portion of the inner diameter of the exhaust outlet is to the rear of the rear panel 17.

Figure 8:
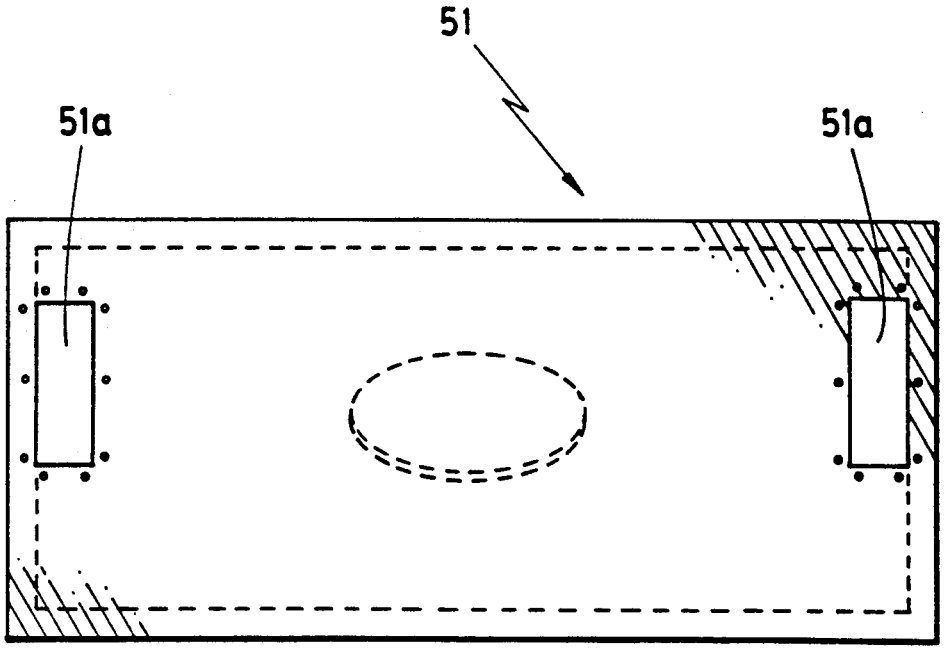
FIG. 8 is a plan view of the underside of a heat exchanger used in the fireplace of FIG. 1.

A heat exchanger 51 may be mounted in-line with the duct 29 in the passage 27. A blower 53 may rest in the passage 27. As shown in FIG. 8 the heat exchanger 51 has a cut-out 51*a* on either end to receive the ends 29*d* of the duct portions 29*a* described earlier.

The bottom 9 is sloped upwardly toward the rear panel 7. Logs 55 are mounted in the firebox 3, one log A to the front, one B to the rear and one or more C placed across the other two logs A, B. A front burner 57 rests to the bottom of and in front of log A, while a back burner 59 is placed to the bottom of and in front of rear log 55B. A grate 61 sits in front of the front burner 57 to block it from view and may simulate a fireplace grate. The bottom 9 is sloped to allow the rear log B to be viewed over the front log A and provide a more pleasing appearance, without having to add additional mounting beneath the log B.

A combustion air conduit 63 is defined by a substantially vertical sheet 65 between the rear surface 21 and rear panel 7, opening into a pair of rectangular tunnels 67, which in turn open into a tray 69. A gap 72 is left in the inclined surface 26 above the area between the sheet 65 and the rear surface 21.

Figure 9:
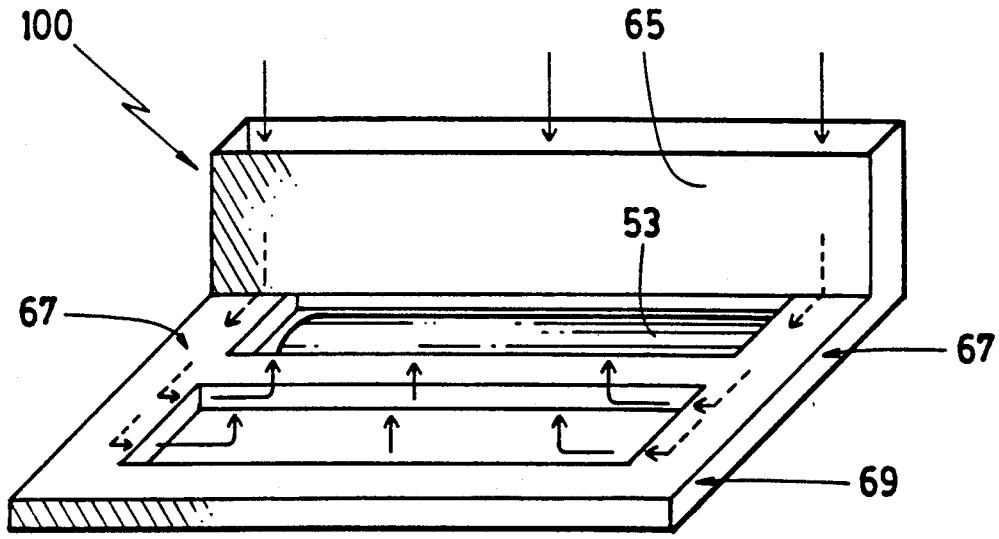
FIG. 9 is a perspective view from above, to one side and the front of a combustion air conduit unit for use in the fireplace of FIG. 1.

As shown in FIG. 9, the combustion air conduit 63 of FIG. 1 may be defined by a pre-formed combustion air conduit unit 100 having integral tray 69, tunnels 67 and vertical sheet 65 which fits around the gap 72. Although it is difficult to see, the tray 69 is open to the bottom 9 of the firebox 3, but not to the passage 27. As shown by the arrows, the combustion air flow through the gap 72 into the unit 100, passes the sheet 65 and the tunnels 67, to open through the tray 69 to the bottom 9 of the firebox 3. Room air passes between the tunnels 67 and the blower 53 may aid the flow of room air.

The adaptor 34 also has an outer cap 73 mounted to the inclined surface 26 over the inner cap 35 and the gap 72. The outer cap has a rectangular top 75, rear 77 and sides 79. Flanges 81 extend from the top 75, rear 77 and sides 79 over an outer gasket 83 and may be mounted using sheet metal screws, not shown, or the like. Extending from the top 75 is an outer collar 85 which is concentric with the inner collar 47 and opens into a combustion air channel 89 formed between the inner cap 35 and outer cap 73.

As described previously, the adaptor 34 may be mounted in a vertical and horizontal position and the outer cap 73 will be mounted accordingly.

The combustion air channel 89 opens into the conduit 63 through the gap 72.

Figure 6:
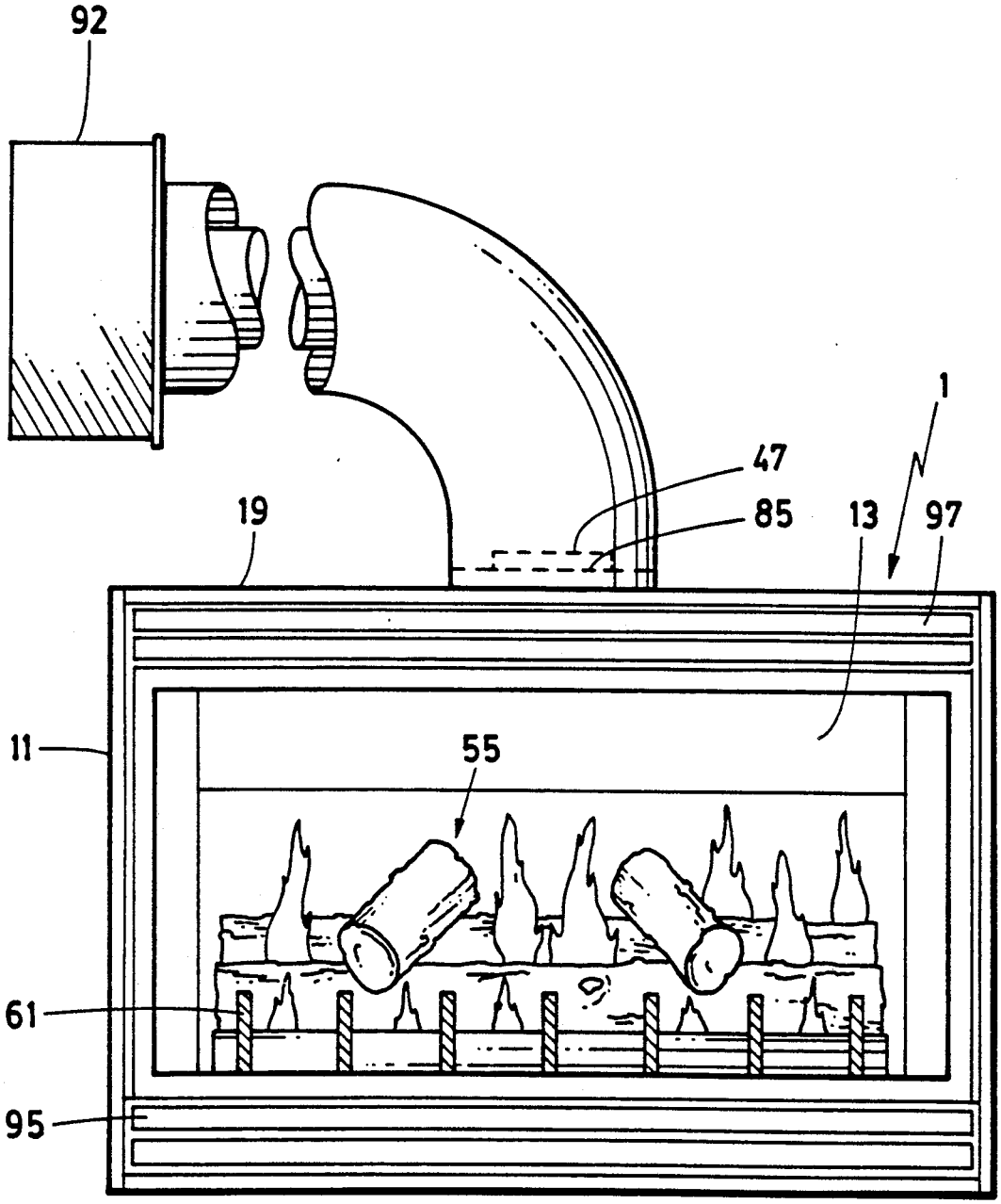
FIG. 6 is a front elevation of the assembly of FIG. 1 with vent ducting attached.

As shown in FIG. 6, a double walled vent duct 91 can be connected to the collars 47, 85 at one end and to a vent cap 92 on the other through an exterior wall of a building as is known in the art.

In operation, gas flows through the burners 57, 59 and is ignited by a pilot, not shown. The resulting flame heats the logs 55 which are specially designed to glow and simulate a natural fire. The air within the firebox 3 is heated and, through convection, flows out the aperture 31 through the duct 29 and the heat exchanger 51. From the heat exchanger 51, the exhaust air flows through the opening 33 into the inner cap 35 and out through the inner collar 47.

As the exhaust air leaves the firebox 3, combustion air is drawn through the conduit 63 and the channel 89.

A combustion air blower, not shown, may be employed either as an aid for venting or as a safety prepurge to vent any accumulation of explosive gas air mixture prior to ignition.

The room air is also drawn by convection through a lower grill 95 around the firebox 3 and out through an upper grill 97. The blower 53 assists the flow of room air.

The position of the heat exchanger 51 and the aperture 31 away from the top 5, allows space for a relief door, not shown, on the top 5.

Also, the position of the aperture 31 on a side 11 can provide for an additional length of ducting when compared to an aperture in the inclined panel 15. This promotes the exchange of heat to the passage 27.

Figure 10:
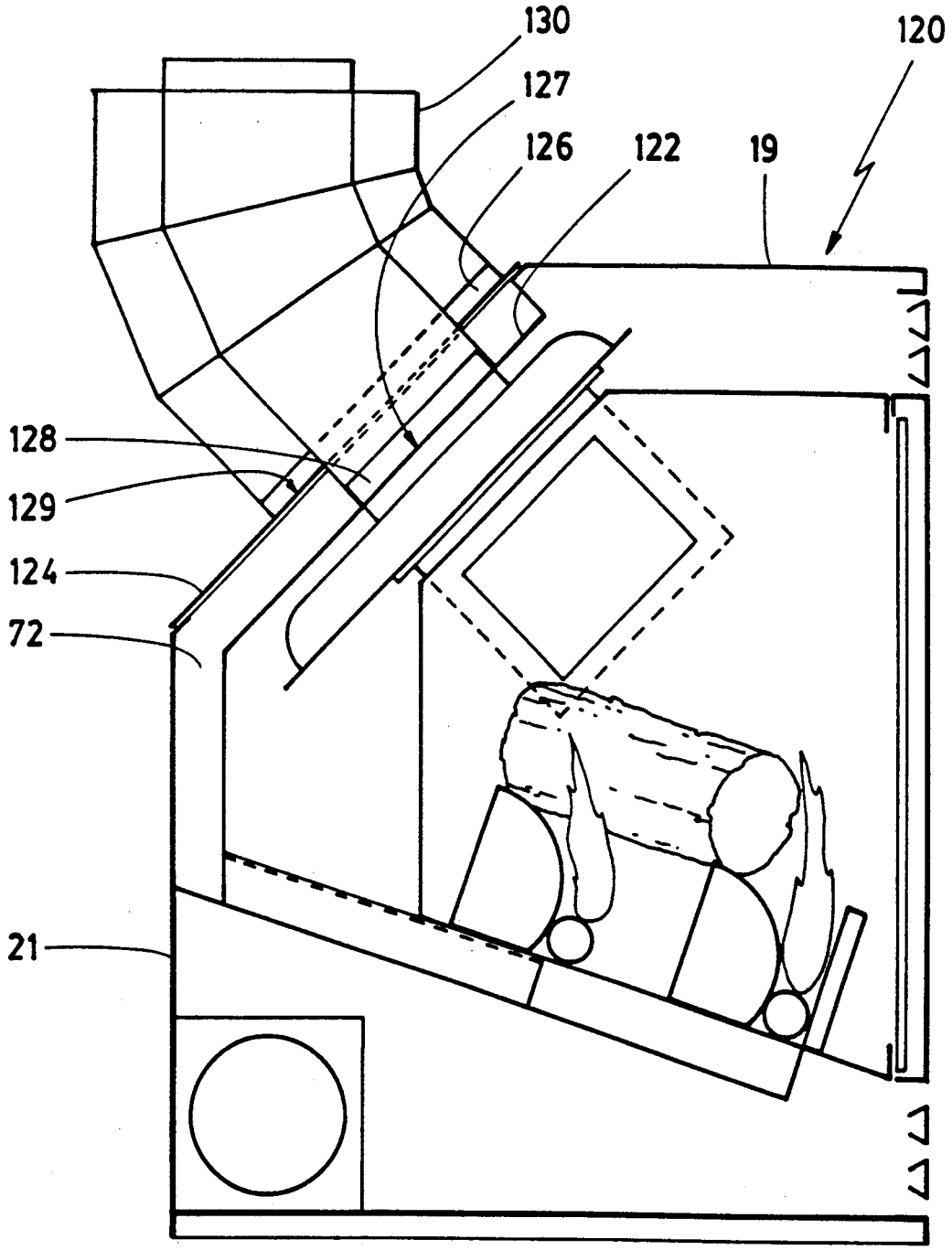
FIG. 10 is a cross-sectional side view of embodiments of a fireplace and vent duct assembly in a vertical position.
Figure 11:
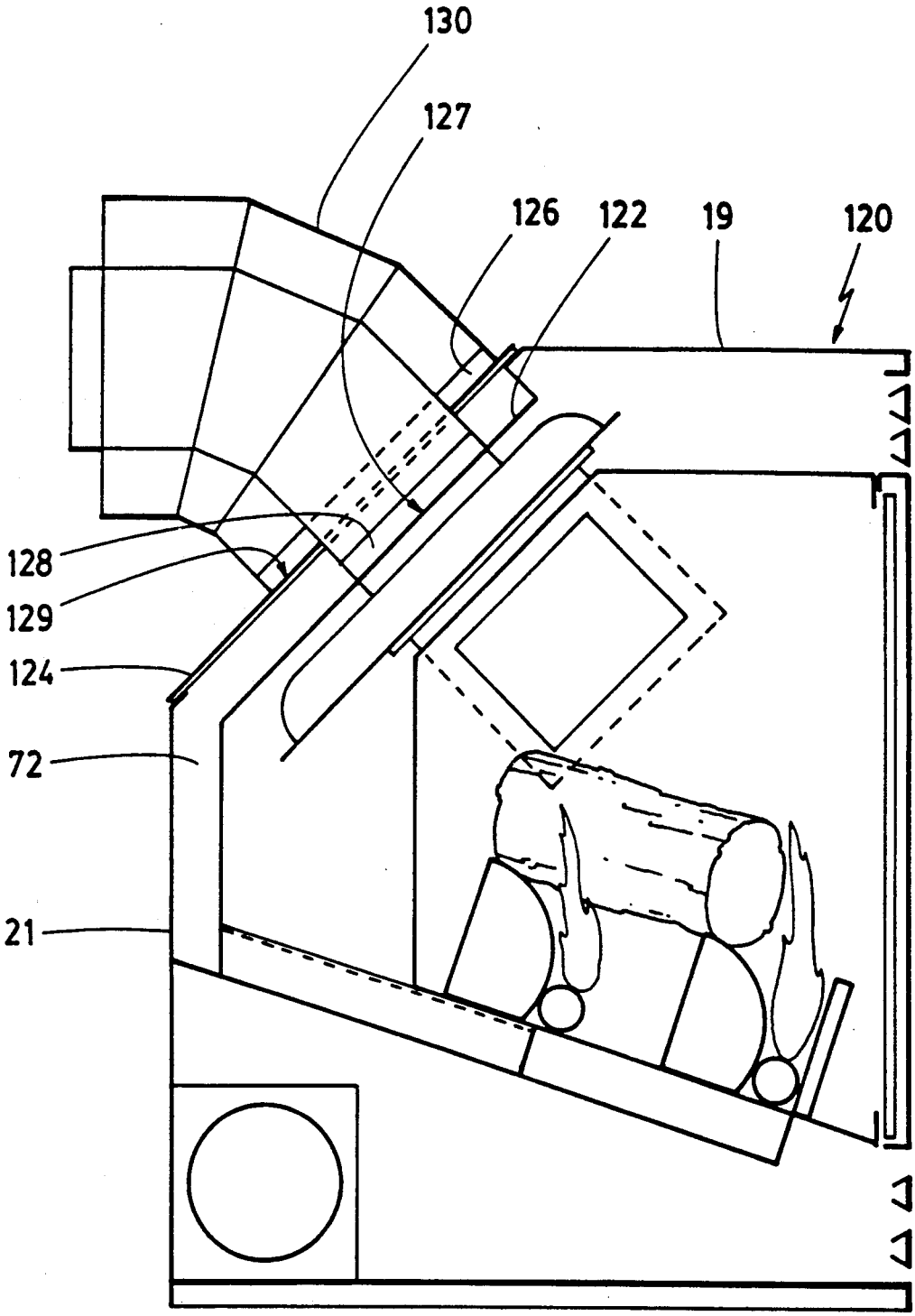
FIG. 11 is a cross-sectional side view of the assembly of FIG. 10 in a horizontal position.

As shown in FIGS. 10 and 11, in an alternate embodiment a fireplace 120 has an inclined surface 122 and a substantially parallel inclined plate 124. The other components of the fireplace 120 correspond generally with those of the fireplace 1, unless expressly indicated.

The rear surface 21 extends above the surface 122 in order to meet the plate 124. An outer collar 126 extends from the plate 124 about an combustion air hole, shown generally at 127, while an inner collar 128 extends from the surface 122 about a exhaust opening, shown generally at 129.

At the upper end of the surface 122 it bends toward the plate 124. This allows the surface 122 and plate 124 to be joined at a single point to the top surface 19.

The hole 129 is larger than the opening 127 to allow a double walled vent duct 130 to be attached to the inner and outer collars 126, 128 to provide an inlet for combustion air and an outlet for exhaust air. The gap 72 still remains in the surface 122, in this case at the lower end bordered by the rear surface 21. The air flow of the fireplaces 1, 120 would otherwise be similar.

The duct 130 can have a fixed angle and be rotated about the collars 126, 128 to provide for vertical venting as shown in FIG. 10 and horizontal venting as shown in FIG. 11. Standard ducts 130 come in 30, 45 and 60 degree elbows.

Due to the size of standard elbows they may extend beyond the top or rear surfaces 19, 21 in horizontal and vertical applications, respectively. This may be acceptable, for example in vertical corner applications, where the fireplace 120 may be moved away from a wall.

Alternatively, a custom duct, not shown, can be made or flexible vent ducting used.

It will be understood by those skilled in the art that this description is made with reference to the preferred embodiments and that it is possible to make other embodiments employing the principles of the invention which fall within its spirit and scope as defined by the following claims.

We claim:

1. A direct vent gas fireplace, comprising:

a firebox having top, rear, bottom and two side panels, and a front viewing window;

an enclosure spaced away from the firebox and having top, rear, bottom and two side surfaces;

a passage for room air between the enclosure and the firebox;

an exhaust opening in an inclined surface of the enclosure located between the top, rear, and side surfaces and inclined to the top and rear surfaces;

a duct connecting the opening to at least one exhaust aperture in the firebox; and a combustion air conduit exiting into the firebox and commencing at a gap in the inclined surface; and wherein, the enclosure is adapted to be mounted with an inner cap over the opening, the inner cap having an exhaust outlet;

the enclosure is adapted to be mounted with an outer cap over the inner cap and the gap, the outer cap having an air inlet about the exhaust outlet; and the inner and outer caps are adapted to define a combustion air channel from the inlet to the gap and are adapted to be mounted in at least a substantially horizontal and a substantially vertical position, in the horizontal position the axis of the exhaust outlet is substantially horizontal and in the vertical position the axis of the exhaust outlet is substantially vertical.

2. The gas fireplace of claim 1, wherein the at least one aperture is in one of the side panels of the firebox.

3. The gas fireplace of claim 1, wherein there are two apertures, one in each side panel, and the duct connects the opening to each of the apertures.

4. The gas fireplace of claim 1, wherein a heat exchanger is in line with the duct in the passage.

5. The gas fireplace of claim 4, wherein, the firebox has an inclined panel between the top, rear and side panels, and the inclined panel is substantially parallel to the inclined surface.

6. The gas fireplace of claim 5, wherein the inclined surface falls within a range of from 30 to 60 degrees from vertical.

7. The gas fireplace of claim 5, wherein the inclined surface is inclined substantially at an angle selected from the group consisting of 30, 45, and 60 degrees from vertical.

8. The gas fireplace of claim 7, wherein, the inclined surface is inclined at approximately 45 degrees.

9. The gas fireplace of claim 8, wherein, a heat exchanger is placed in line with the duct and rests substantially between the inclined surface and the inclined panel, within the passage.

10. The gas fireplace of claim 9, wherein the at least one aperture is in one of the side panels of the firebox and a portion of the duct connects the at least one aperture to an underside of the heat exchanger extending beyond the side panel in which the at least one aperture is located.

11. The gas fireplace of claim 10, wherein there are two apertures, one in each side panel, and two portions of the duct connect the apertures to the underside of the heat exchanger beyond either side panel.

12. The gas fireplace of claim 8, wherein, the conduit is formed from a sheet spaced away from the rear surface toward the passage so that the gap is between the sheet and the rear surface, at least one tunnel extends from the space between the rear surface and the sheet toward a tray beneath the bottom of the firebox, and the space is otherwise enclosed to the rear surface from the sheet, and wherein, the combustion air flows through the gap past the sheet, through the tunnel, over the tray and into the firebox through the bottom panel.

13. The gas fireplace of claim 12, wherein the conduit is formed from a pre-fabricated combustion air conduit unit.

14. The gas fireplace of claim 12, wherein, the bottom panel is sloped upwardly from the front to the rear, and a fan rests in the passage to the rear and bottom of the fireplace, and the tunnel passes above the fan into the tray.

15. An angle adaptor for use in association with a fireplace comprising an exhaust opening and a gap in a surface inclined between the top and rear surfaces of the fireplace enclosure, the angle adaptor comprising:

an inner cap for mounting to the enclosure over the opening, the inner cap having an exhaust outlet;

an outer cap for mounting to the enclosure over the inner cap and the gap, and having an air inlet about the exhaust outlet; and wherein, the inner and outer caps define a combustion air channel from the inlet to the gap and the caps are adapted to be mounted in at least a substantially horizontal and a substantially vertical position, in the horizontal position the axis of the exhaust outlet is substantially horizontal and in the vertical position the axis of the exhaust outlet is substantially vertical.

16. An assembled gas fireplace and adaptor, comprising:

a gas fireplace, comprising;

a firebox having top, rear, bottom and two side panels, and a front viewing window;

an enclosure spaced away from the firebox and having top, rear, bottom and two side surfaces;

a passage for room air between the enclosure and the firebox;

an exhaust opening in an inclined surface of the enclosure located between the top, rear, and side surfaces and inclined to the top and rear surfaces; and a duct connecting the opening to an exhaust aperture in the firebox;

a combustion air conduit exiting into the firebox and commencing at a gap in the inclined surface; and an angle adaptor, comprising;

an inner cap for mounting to the enclosure over the opening, the inner cap having an exhaust outlet;

an outer cap for mounting to the enclosure over the inner cap and the gap, and having an air inlet about the exhaust outlet; and wherein, the inner and outer caps define a combustion air channel from the inlet to the gap and the caps are adapted to be mounted in at least a substantially horizontal and a substantially vertical position, in the horizontal position the axis of the exhaust outlet is substantially horizontal and in the vertical position the axis of the exhaust outlet is substantially vertical.

17. A kit, comprising:

a gas fireplace and adaptor, wherein the fireplace comprises:

a firebox having top, rear, bottom and two side panels, and a front viewing window;

an enclosure spaced away from the firebox and having top, rear, bottom and two side surfaces;

a passage for room air between the enclosure and the firebox;

an exhaust opening in an inclined surface of the enclosure located between the top, rear, and side surfaces and inclined to the top and rear surfaces;

a duct connecting the opening to an exhaust aperture in the firebox; and a combustion air conduit exiting into the firebox and commencing at a gap in the inclined surface;

and wherein the adaptor comprises:

an inner cap for mounting to the enclosure over the opening, the inner cap having an exhaust outlet;

an outer cap for mounting to the enclosure over the inner cap and the gap, and having an air inlet about the exhaust outlet; and wherein, the inner and outer caps define a combustion air channel from the inlet to the gap and the caps are adapted to be mounted in at least a substantially horizontal and a substantially vertical position, in the horizontal position the axis of the exhaust outlet is substantially horizontal and in the vertical position the axis of the exhaust outlet is substantially vertical.

18. A direct vent gas fireplace, comprising:

a firebox having top, rear, bottom and two side panels, and a front viewing window;

an enclosure spaced away from the firebox and having top, rear, bottom and two side surfaces;

a passage for room air between the enclosure and the firebox;

an exhaust opening in an inclined surface of the enclosure located between the top, rear, and side surfaces and inclined to the top and rear surfaces, the opening being at least partially offset from the firebox;

a duct connecting the opening to at least one exhaust aperture in the firebox; and a combustion air conduit exiting into the firebox and commencing at a gap in the inclined surface; and wherein the enclosure is adapted to be mounted with an inner cap over the opening, the inner cap having an exhaust outlet;

the enclosure is adapted to be mounted with an outer cap over the inner cap and the gap, the outer cap having an air inlet about the exhaust outlet; and the inner and outer caps are adapted to define a combustion air channel from the inlet to the gap and are adapted to be mounted in at least a substantially horizontal and a substantially vertical position, in the horizontal position the axis of the exhaust outlet is substantially horizontal and in the vertical position the axis of the exhaust outlet is substantially vertical.

19. A direct vented gas fireplace, comprising:

a firebox having top, rear, bottom and two side panels, and a front viewing window;

an enclosure spaced away from the firebox and having top, rear, bottom and two side surfaces;

a passage for room air between the enclosure and the firebox;

an exhaust opening in an inclined surface of the enclosure located between the top, rear, and side surfaces and inclined to the top and rear surfaces;

a duct connecting the opening to at least one exhaust aperture in the firebox;

a combustion air conduit exiting into the firebox and commencing at a gap in the inclined surface;

an inclined plate substantially parallel to the inclined surface over the gap and the outlet, the plate having a hole substantially concentric with the exhaust opening and of greater area; and wherein, the hole and openings are adapted to receive a substantially tubular double walled vent duct, a first wall of the duct for enclosing the exhaust opening and a second wall of the duct for enclosing the hole.

20. The fireplace of claim 19 in combination with the substantially tubular double walled vent duct, the duct being connected to a vent cap in a source of combustion air and exhaust release.

21. A direct vent gas fireplace, comprising:

a firebox having top, rear, bottom and two side panels, and a front viewing window;

an enclosure spaced away from the firebox and having top, rear, bottom and two side surfaces;

a passage for room air between the enclosure and the firebox;

an inclined plate having a hole and being located between the top, rear, and side surfaces and inclined to the top and rear surfaces;

an exhaust opening of smaller diameter than the hole and substantially concentric with the hole;

a duct connecting the opening to at least one exhaust aperture in the firebox; and a combustion air conduit for conducting combustion air from between the hole and the exhaust opening; and wherein, the hole and opening are adapted to receive a substantially tubular double walled vent duct, a first wall of the duct for enclosing the exhaust opening and a second wall of the duct for enclosing the hole.

22. The fireplace of claim 21, further comprising an inner collar about the outlet and an outer collar about the hole.

23. The fireplace of claim 22 in combination with the substantially tubular double walled vent duct, the first wall of the duct enclosing the inner collar and the second wall enclosing the outer collar.

24. The combination of claim 23, wherein the plate is inclined at substantially 45 degrees, and the duct has a substantially 45 degree elbow immediately adjacent the plate.

25. The combination of claim 23, wherein the duct comprises flexible vent ducting.

* * * * *